US005337225A

United States Patent [19]

Brookman

[11] Patent Number: 5,337,225

[45] Date of Patent: Aug. 9, 1994

[54] LIGHTING STRIP SYSTEM

[75] Inventor: Marc A. Brookman, Dearborn, Mich.

[73] Assignee: The Standard Products Company, Cleveland, Ohio

[21] Appl. No.: 1,066

[22] Filed: Jan. 6, 1993

[51] Int. Cl.[5] ..... F21S 5/00

[52] U.S. Cl. ..... 362/145; 362/147; 362/226; 362/457; 362/800

[58] Field of Search ..... 362/145, 147, 152, 226, 362/457, 458, 800, 806

[56] References Cited

U.S. PATENT DOCUMENTS

| | | | |
|---|---|---|---|
| 2,920,184 | 1/1960 | Kessler | 362/152 |
| 3,500,036 | 3/1970 | Szentueri | 362/152 |
| 4,143,931 | 3/1979 | Skare et al. | 362/145 X |
| 4,338,653 | 7/1982 | Marreo | 362/147 X |
| 4,376,966 | 3/1983 | Tieszen . | |
| 4,413,311 | 11/1983 | Orenstein . | |
| 4,521,839 | 6/1985 | Cook et al. . | |
| 4,600,975 | 7/1986 | Roberts | 362/147 |
| 4,712,165 | 12/1987 | Cetrone | 362/147 |
| 4,899,266 | 2/1990 | Ahroni . | |
| 4,924,362 | 5/1990 | Janko et al. . | |
| 4,994,944 | 2/1991 | Vernondier . | |

*Primary Examiner*—Larry Jones

*Attorney, Agent, or Firm*—Harness, Dickey & Pierce

[57] ABSTRACT

The present invention relates to a lighting strip system including interconnectable lighting strip sections and connector sections. The lighting strip sections include lighting means such as light emitting diodes or incandescent lamps encapsulated in a polymeric molding. The connector sections include metallic inserts or metallic strips which partially extend from the polymeric molding of the connector section wherein the metallic inserts or metallic strips are plugged into the lighting strip sections to form an electrical junction between an adjacent lighting strip section and connector section. The lighting strip system is particularly useful for pathway lighting.

20 Claims, 4 Drawing Sheets

LIGHTING STRIP SYSTEM

BACKGROUND OF THE INVENTION

The present invention relates to lighting strips and connector systems therefor. More particularly, the invention relates to a lighting strip system including lighting strips having light-emitting diodes (LEDs) or incandescent bulbs and connector strips which allow for electrical contact between the individual lighting strips. The elements which make up the lighting strip system are encapsulated within a polymeric material to protect the lighting assembly and provide the light strips and connector strips with the desired overall shape. The lighting strip system according to the present invention is particularly useful as pathway lighting and other light marking strips.

Lighting strips and illuminated systems such as signs, displays, and other lighting systems which incorporate tubes filled with inert gases, such as neon, argon, and xenon among others have been used for many years. Such signs and displays typically have extended life spans, can be formed to a variety of different shapes and are operative at a relatively low cost. For example, U.S. Pat. No. 4,413,311 which issued Nov. 1, 1983 to Orenstein, discloses illuminated modules insertable into connectors having electrical leads hidden within the connectors to electrically join the illuminated modules. Each connector has a hollow body adapted to receive an illuminated module including a transparent plastic sleeve with an annular collar and a gas filled tube retained within the sleeve by the collars.

Although illuminating systems having gas filled tubes have been somewhat successful, the known illuminating systems which have included gas filled tubes have encountered certain problems. One known problem is the excessive number of components required to make such illumination systems. Another problem relates to the fragile nature of such illumination systems. Often illuminating systems incorporating gas filled tubes must be individually crafted which increases the purchasing price associated with such illumination systems. Of the known illumination systems another problem relates to the lack of interconnectability and interchangeability of individual lighting sections.

Thus, there remains a need for an improved lighting strip system which is interconnectable and interchangeable with other lighting strips having a variety of shapes. In particular, there remains a need for an improved lighting strip system having light strip sections which are flexible, can be cut to the desired length, and are interconnectable and interchangeable with a number of light strip sections having varying overall shapes. The present invention can be made to include either incandescent or light-emitting diode (LED)lighting sources.

SUMMARY OF THE INVENTION

The present invention relates to a lighting strip system including lighting strip sections and connector sections for providing an electrical junction between the lighting strip sections. The lighting strip sections include a lighting source such as an incandescent lamp or light-emitting diode (LED) having extending lead wires, a pair of oppositely chargeable wires or metallic strips connected to the lead wires and running longitudinally within a polymeric material which encapsulates the light source assembly and apertures extending adjacently along the oppositely chargeable wires or metallic strips. The connectors for joining one or more of the lighting strip sections according to the teachings of one embodiment of the present invention include a pair of oppositely chargeable wires encapsulated within a polymeric material and metallic inserts in contact with the oppositely chargeable wires which are insertable into the apertures of the lighting strip sections to provide an electrical connection between the light strip section and the connectors. According to another embodiment of the present invention the connectors include a pair or oppositely chargeable metallic strips encapsulated within a polymeric material and having end portions which project from the polymeric material. The end portions of the metallic strips are insertable into the apertures of the lighting strip sections to also provide an electrical connection between a lighting strip and connector sections. Preferred embodiments of the lighting strip system include pathway lighting for walls, ceilings, floors and walk-ways.

DESCRIPTION OF THE INVENTION

Figure 1:
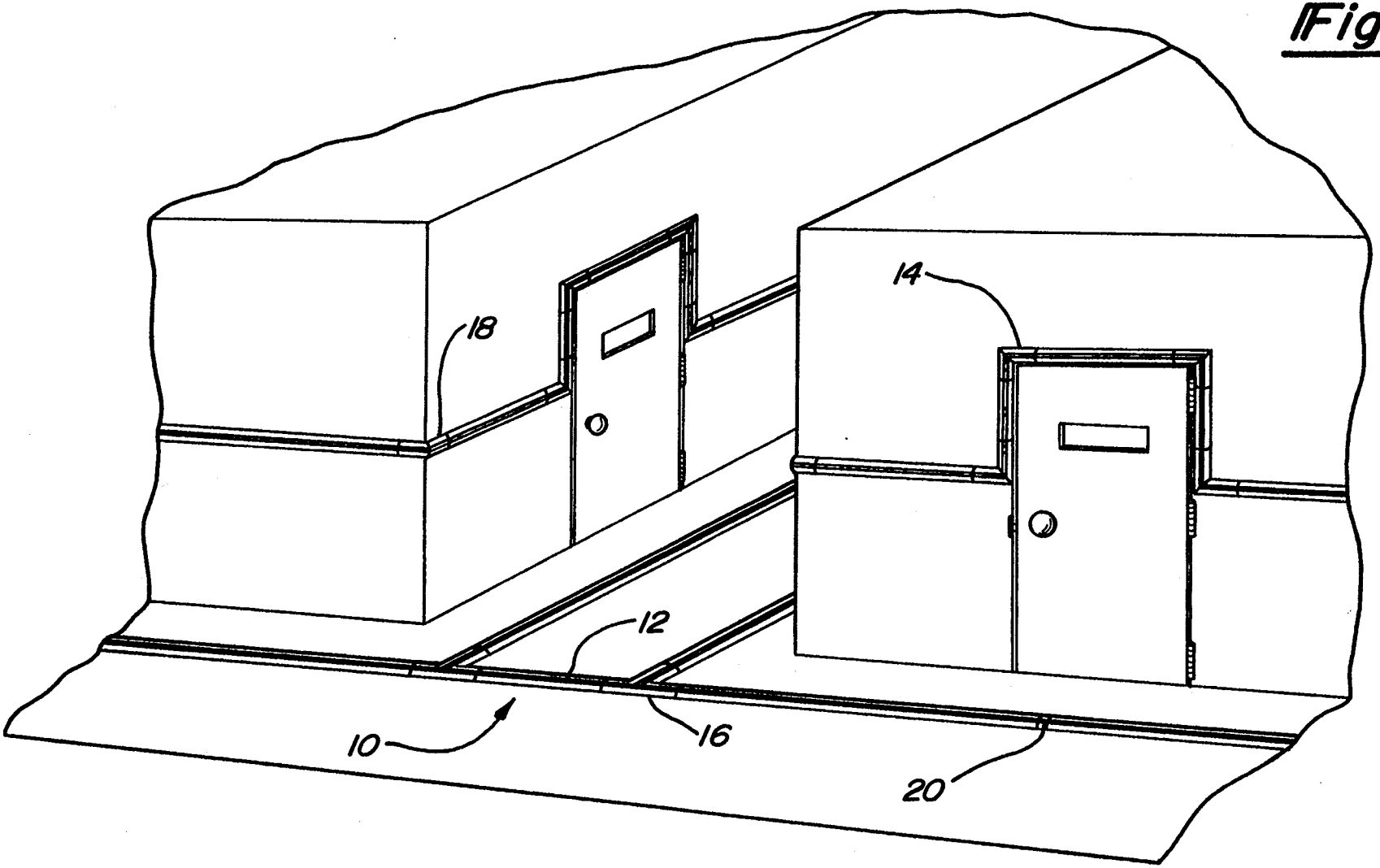
FIG. 1 is a perspective view illustrating various embodiments of the present invention disposed on a plurality of surfaces.

Referring to FIG. 1, a perspective view illustrating various embodiments of the present invention disposed on a plurality of surfaces is provided. The lighting system 10 includes one or more lighting strip sections 12 formed to be operational individually or preferably in connection with other strip sections. Included among the various preferred strip section designs are straight lighting strip sections 12, uni-planar right angle connector sections 14, T-shaped connector sections 16, bi-planar right angle connector sections 18 and straight connector sections 20, although other lighting strip section and connector section designs arc contemplated. While FIG. 1 illustrates a preferred use for the present invention as a pathway lighting for ceilings, floors and walls it will be understood by those skilled in the art that the present invention has a variety of other uses.

Figure 2:
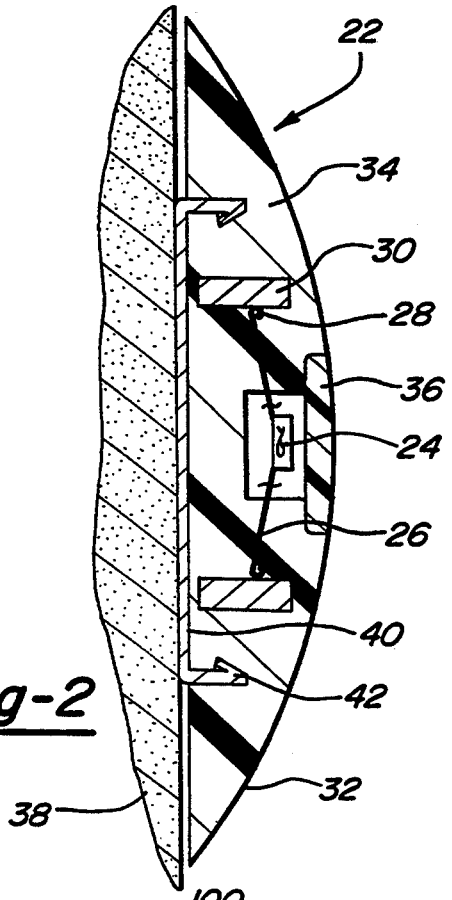
FIG. 2 is a cross-sectional view showing a first lighting strip section according to the teachings of the present invention.

Referring to FIG. 2, a cross-sectional view illustrating a first lighting strip section of the present invention is provided. The lighting strip section 22 includes a lighting source 24 such as an incandescent lamp or light-emitting diode (LED) having extending lead wires 26, a pair of oppositely chargeable wires 28 spaced apart from each other and connected to the lead wires 26 and a polymeric molding 32 which encapsulates the lighting source and wiring. The wires 28 run substantially longitudinally within the polymeric molding 32 which generally includes an opaque portion 34 and a longitudinally disposed transparent portion 36. Many commercially available polymeric molding materials can be utilized to form the polymeric molding one of which is polyvinyl chloride. The chargeable wires are embedded within the opaque portion 34 of the molding strip 32 during formation of the lighting strip section 22. Located along sections of the opaque portion 34 adjacent to the oppositely chargeable wires 28 are apertures 30 which provide access to the oppositely chargeable wires 28. The light strip section 22 may be attached to the desired substrate 38 in any suitable manner. According to this embodiment, the substrate 38 has attached thereto a bracket member 40 having hooks 42 which are embedded in the polymeric molding 32. The bracket 40 is typically attached to the substrate 38 by an adhesive or by mechanical fasteners or by a combination of adhesive and mechanical fastening.

Figure 3:
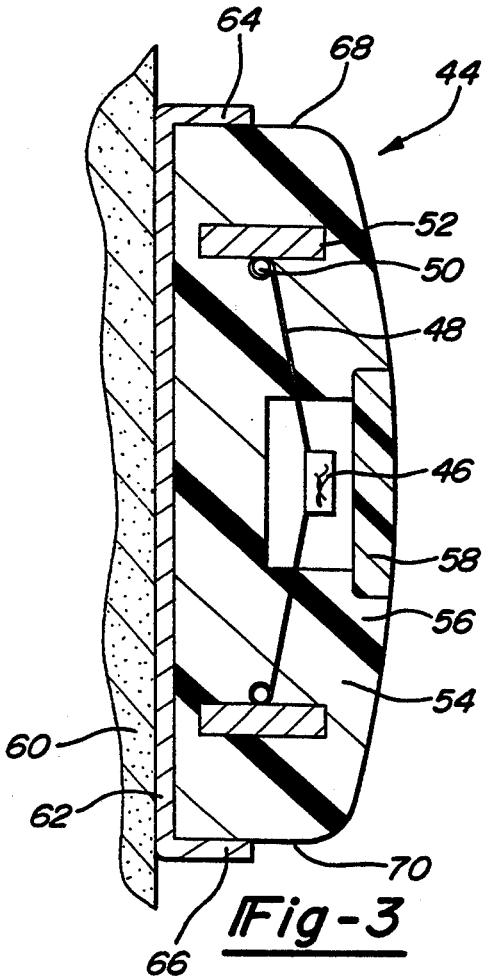
FIG. 3 is a cross-sectional view illustrating an alternative lighting strip section according to the teachings of the present invention.

Referring to FIG. 3, a cross-sectional view illustrating a second light strip section embodiment of the present invention is provided. The light strip section 44 of this embodiment again includes an LED or incandescent lighting source 46 having extending lead wires 48, a pair of oppositely chargeable wires 50 spaced apart from each other and connected to the lead wires 48 and a polymeric molding 54 having an opaque portion 56 and a longitudinal transparent portion 58. The polymeric molding is provided with apertures 52 extending the length of the strip section and located adjacent the oppositely chargeable wires 50. According to this embodiment the light strip section 44 is attached to the substrate 60 by a bracket 62 having ends 64 and 66, respectively, which project in the direction of the light strip section. The light strip section is inserted into the bracket 62 such that the edges 68 and 70 of the polymeric molding 54 fittingly engage the bracket ends 64 and 66 thereby securing the light strip section 44 within bracket 62. Hereto, the bracket may be attached to the substrate adhesively, mechanically or by a combination thereof.

Figure 4:
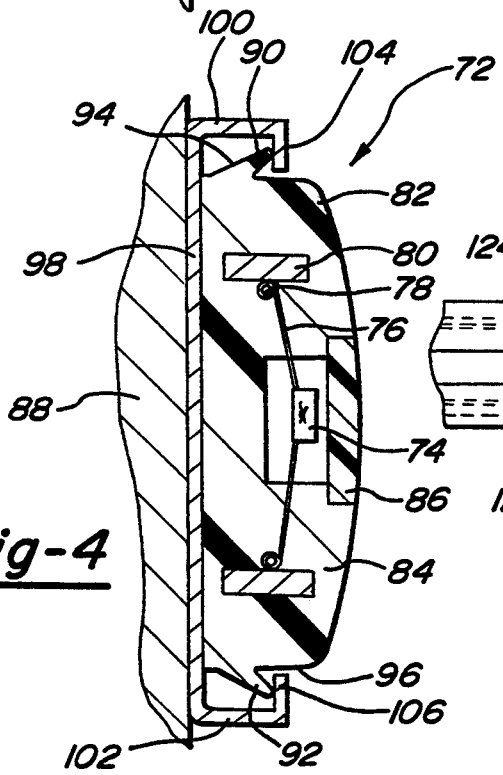
FIG. 4 is a cross-sectional view illustrating yet another light strip section according to the teachings of the present invention.

FIG. 4 demonstrates yet another light strip section embodiment according to the teachings of the present invention. The light strip section 72 of this embodiment generally includes the same elements as the other embodiments, namely a lighting source 74, extending lead wires 76, a pair of oppositely chargeable wires 78, apertures 80 extending longitudinally along the strip section adjacent the oppositely chargeable wires, and a polymeric molding 82 having an opaque portion 84 and a transparent portion 86.

A bracket member 98 having upwardly projecting ends 100 and 102 which include incurved flanges 104 and 106, respectfully, is utilized to attach the polymeric molding to the substrate 88. Upon insertion of the lighting strip into the bracket the outwardly projecting tabs 90 and 92 which extend from the mold edges 94 and 96, respectively, become engaged by the incurved flanges 104 and 106 to retain the molding within the bracket.

Figure 5:
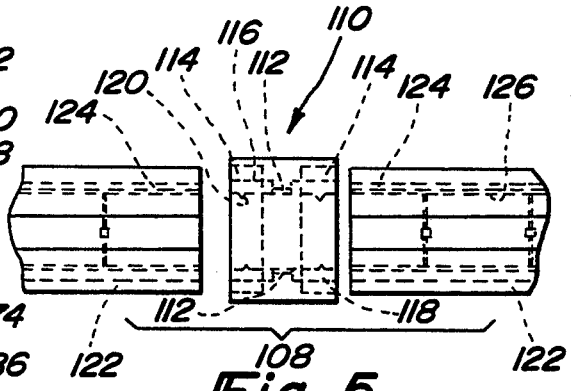
FIG. 5 is a top view illustrating a lighting strip system according to the teachings of the present invention.

Referring to FIG. 5 a top view illustrating a first lighting strip system 108 according to the teachings of the present invention is illustrated. It should be understood by those skilled in the art that each of the lighting strip section embodiments disclosed in FIGS. 2, 3 and 4 can be utilized within the system illustrated in FIG. 5.

Figure 7:
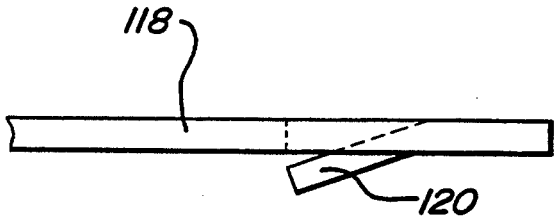
FIG. 7 is a side elevation view of a metallic insert having a barbed end according to the teachings of the present invention.
Figure 8:
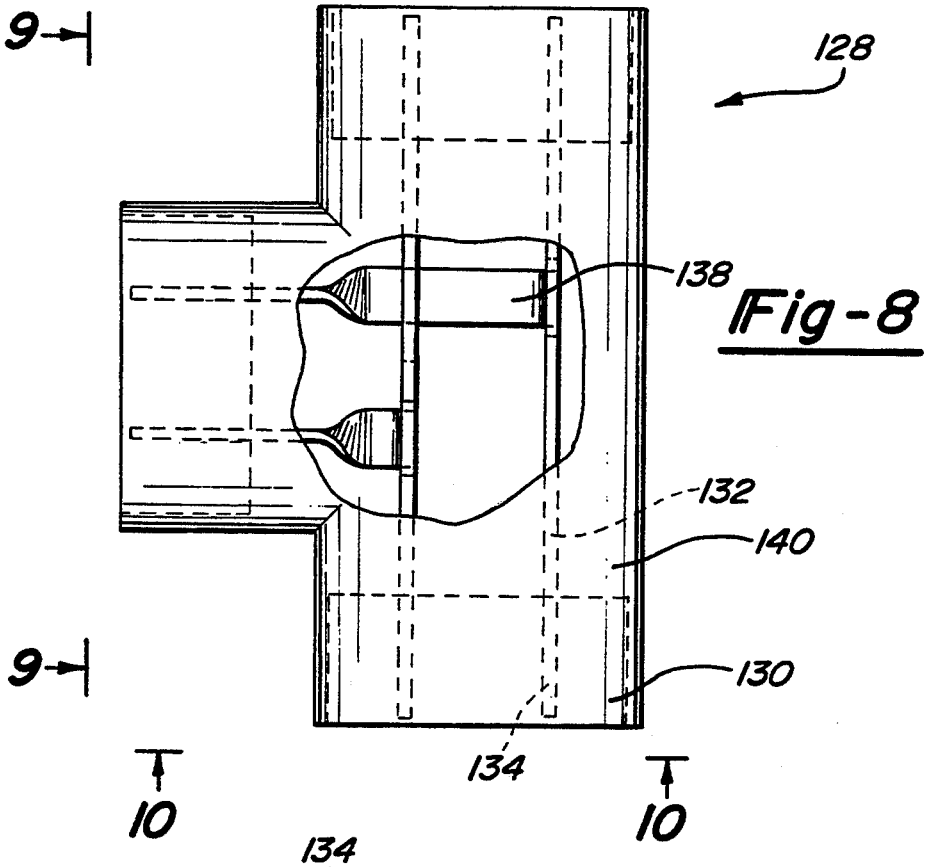
FIG. 8 is a top view illustrating an alternative connector section according to the teachings of the present invention.
Figure 9:
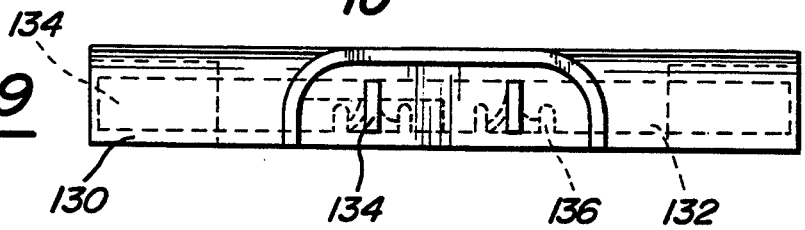
FIG. 9 is an end view of the connector section of FIG. 8 taken along lines 9—9.
Figure 10:
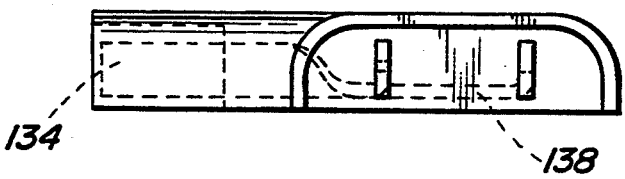
FIG. 10 is an end view of the connector section of FIG. 8 taken along lines 10—10.
Figure 11:
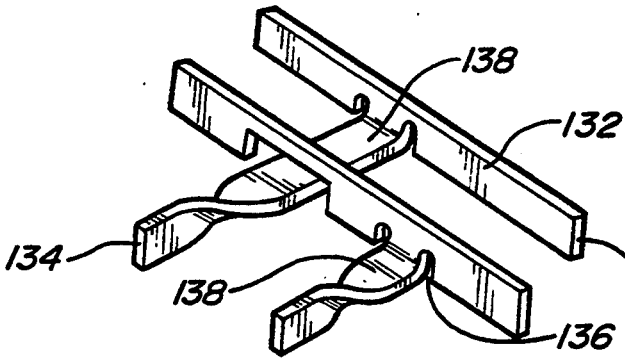
FIG. 11 is a view illustrating the arrangement of the metallic strips contained within the connector section of FIG. 8.

A connector section 110 is provided with a pair of oppositely chargeable wires 112 embedded within a polymeric molding 120 formed by injection molding. The polymeric molding 120 is provided with pockets 114 formed on each end for receiving a lighting strip section 122. Metallic inserts 118 are positioned within apertures 116 located adjacent the oppositely chargeable wires 112. A first end of the metallic insert is in contact with the oppositely chargeable wires 112 of the connector section and a second end extends into the pocket 114. As shown more clearly with reference to FIG. 7, barbs 120 are provided on the metallic inserts and extend inwardly in the direction of the opposing insert. Once the connector strip is provided with the metallic inserts, the lighting strip section 122 is plugged into the pocket 114 of the connector section 110 such that the aperture 124 of the lighting strip section 122 snugly fits over the exposed portion of the metallic inserts 118. Upon connection of the light strip sections 122 to the connector section 110 the barbs 120 contained on the metallic inserts scratch the oppositely chargeable wires 126 of the lighting strip sections 122 to enhance the electrical conductivity between the connector strip 110 and the lighting strip sections 122. Upon providing the proper electrical charge to the oppositely chargeable wires of either a connector strip or a lighting strip section the electrically conductive junction formed between the sections allows the lighting system to become illuminated.

Figure 6:
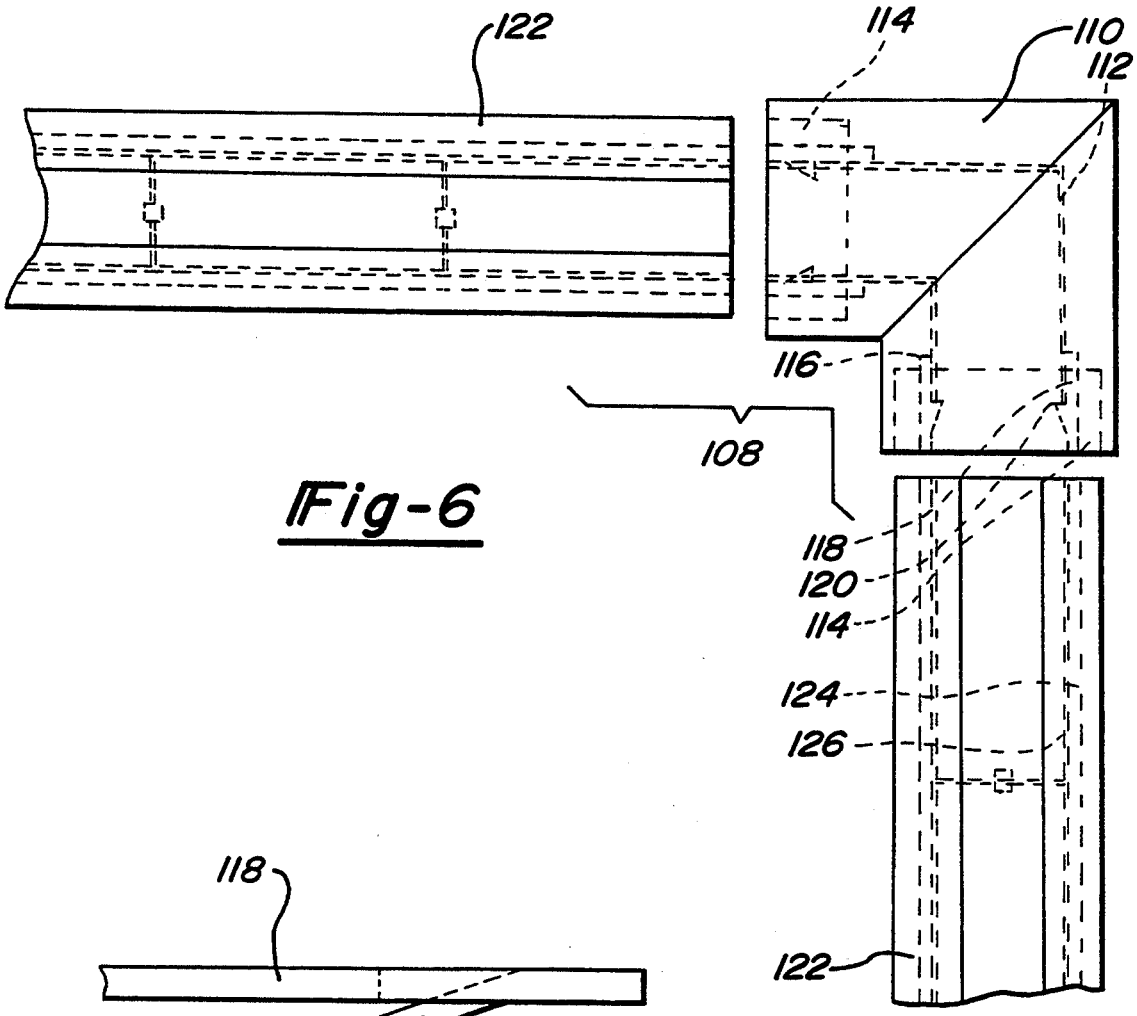
FIG. 6 is a top view illustrating an alternative lighting strip system according to the teachings of the present invention.

Referring to FIG. 6 an alternative embodiment of the lighting system of the present invention is provided. The lighting system is essentially the same as that shown in FIG. 5 with the exception of the overall shape of the connector strip, therefore like reference numerals are used. According to this embodiment of the lighting strip system 108 the connector strip 110 is a uni-planar branched piece having an overall L-shape which is useful for joining lighting strip sections 122 advancing from two different directions. The lighting strip sections 122 are again inserted into the pockets 114 provided at the ends of the connector strip 110 such that the apertures 124 extending lengthwise within the light strip sections are inserted over the metallic inserts 118 to provide for an electrical connection between the sections.

Referring to FIGS. 8, 9, 10 and 11 an alternative connector embodiment of the lighting strip system according to the teachings of the present invention is provided. According to this embodiment the connector section 128 includes a pair of oppositely chargeable metallic strips 132 embedded within a polymeric molding 140 formed by injection molding. The polymeric molding has an overall T-shape and includes pockets 130 formed on each end for receiving a lighting strip sections. The ends 134 of the metallic strips 132 extend into the pockets 130 of the molding 140 which allow for connection with lighting strip sections as previously described. As can be seen most clearly with reference to FIG. 11 clearance is provided between the bisecting metallic strips such that the metallic strips do not come in contact. The metallical strips 132 utilized for the T-shaped connector sections 128 are provided with slots 136 which allow the strips to be bent such that the projecting portions 138 arc in substantially the same plane as the rest of the metallic strip. The ends of the projecting portions 138 are then twisted to be vertically aligned so the metallic strips can be inserted into the apertures of a light strip section to form an electrical junction.

While the above detailed description describes the preferred embodiment of the present invention, it will be understood that the present invention is susceptible to modifications, variations and alternations without deviating from the scope and spirit of the subjoined claims. For example, it will be noted by one skilled in the art that lengths of metallic strips could be substituted for the oppositely chargeable wires utilized in a number of the above described embodiments. Likewise, the ends of the metallic strips can be extended beyond the polymeric molding and provided with barbs similar to those shown on the metallic inserts to enhance the electrical conductivity between the connector and light strip sections of light strip system. Further, the various connector sections could optionally be provided with lighting sources during formation of the connector sections as described with reference to the lighting strip sections.

I claim:

1. A lighting strip system, comprising:

at least one lighting strip section including at least one lighting means for providing illumination, said at least one lighting means including lead wires extending therefrom, said at least one lighting strip section further including means for carrying an electrical charge, said means for carrying an electrical charge extending the length of said lighting strip section and terminating proximate to the ends of said lighting strip section, said means for carrying an electrical charge being electrically connected to the lead wires, wherein the at least one lighting strip section is formed of a polymeric molding such that the at least one lighting means is positioned within a cavity extending along the length of the lighting strip section and the means for carrying an electrical charge is substantially encapsulated within the polymeric molding, said polymeric molding including apertures at an end of the at least one lighting strip section so as to expose the means for carrying an electrical charge; and connector means for joining said at least one lighting strip section to another lighting strip section, said connector means including means for conveying an electrical charge between the joined lighting strip sections, said means for conveying an electrical charge extending the length of said connector and being partially encapsulated within a polymeric molding such that the ends of said means for conveying an electrical charge project from said polymeric molding;

whereby upon aligning said at least one lighting strip section contiguously against said connector means such that the ends of said means for conveying an electrical charge extend into the apertures of said lighting strip section an electrical junction is formed thus allowing the lighting strip system to become illuminated upon the introduction of an electrical charge.

2. The lighting system according to claim 1, wherein said connector means include pocket means disposed along at least one end for receiving said light strip section.

3. The lighting system according to claim 2, wherein said means for carrying an electrical charge further comprise oppositely chargeable wires.

4. The lighting system according to claim 2, wherein said means for carrying an electrical charge further comprise metallic strips.

5. The lighting strip system according to claim 2, wherein said means for conveying an electrical charge further comprise:

apertures extending into said polymeric molding along said pocket means, oppositely chargeable wires extending substantially the length of said light strip section and terminating at said apertures; and a plurality of metallic inserts having a first end which extends into said apertures and a second end which extends into said pocket means.

6. The lighting system according to claim 5, wherein said metallic inserts include barbed ends.

7. The lighting strip system according to claim 2, wherein said means for conveying an electrical charge further comprises a pair of oppositely chargeable metallic strips having ends which extend into said pocket means.

8. The lighting system according to claim 7, wherein said metallic strips include barbed ends.

9. The lighting system according to claim 2, wherein said connector means has an overall T-shape.

10. The lighting system according to claim 2, wherein said connector means has an overall L-shape.

11. The lighting system according to claim 1, wherein said lighting means include at lease one light emitting diode.

12. The lighting system according to claim 1, wherein said lighting means include at least one incandescent lamp.

13. The lighting system according to claim 1, wherein said polymeric molding of said at least one lighting strip section includes an opaque portion and a relatively transparent portion.

14. The lighting system according to claim 13, wherein said polymeric molding is formed from polyvinyl chloride.

15. The light strip system according to claim 1, further comprising means for attaching said light strip system to a substrate.

16. The lighting system according to claim 15, wherein said means for attaching the lighting strip to a substrate includes at least one bracket member which is adhered to the substrate.

17. The lighting system according to claim 16, wherein said bracket member has upwardly extending hook shaped ends which are embedded within said polymeric molding.

18. The lighting system according to claim 16, wherein said bracket member has upwardly extending ends which fittingly engage the edges of said polymeric molding.

19. The lighting system according to claim 16, wherein said bracket member includes ends having incurred flanges such that said incurred flanges engage outwardly projecting tabs which extend from the molding edges to secure said molding.

20. The lighting system according to claim 1, wherein the lighting strip system is a pathway light.

* * * * *